United States Patent [19]

Kakilashvili et al.

[11] Patent Number: 4,624,287

[45] Date of Patent: Nov. 25, 1986

[54] SHUTTLE UNIT OF A LOOM

[76] Inventors: Isaak Kakilashvili; Shalva Kakilashvili, both of 62-32 99 St., Rego Park, N.Y. 11374

[21] Appl. No.: 624,731

[22] Filed: Jun. 26, 1984

[51] Int. Cl.[4] ..... D03D 49/44

[52] U.S. Cl. ..... 139/134

[58] Field of Search ..... 139/134, 133

[56] References Cited

U.S. PATENT DOCUMENTS 2,112,264 3/1938 Bowles et al. ..... 139/134

2,135,373 11/1938 Wilson ..... 139/134

2,728,884 12/1955 Pestarini ..... 139/134

3,902,535 9/1975 Jusko et al. ..... 139/134

*Primary Examiner*—Henry S. Jaudon

*Assistant Examiner*—Joseph S. Machuga

*Attorney, Agent, or Firm*—Ilya Zborovsky

[57] ABSTRACT

A shuttle unit for a loom includes a shuttle and means forming a reversible electromagnetic field arranged to act on and to reciprocate the shuttle and formed as a linear motor with one or two stators.

9 Claims, 7 Drawing Figures

$$P_2' = P + F_{10A} - F_{10B} \approx P$$

$P_2 = P + F_{10}$ $P_2' = P + F_{10A} - F_{10B} \approx P$

FIG. 3
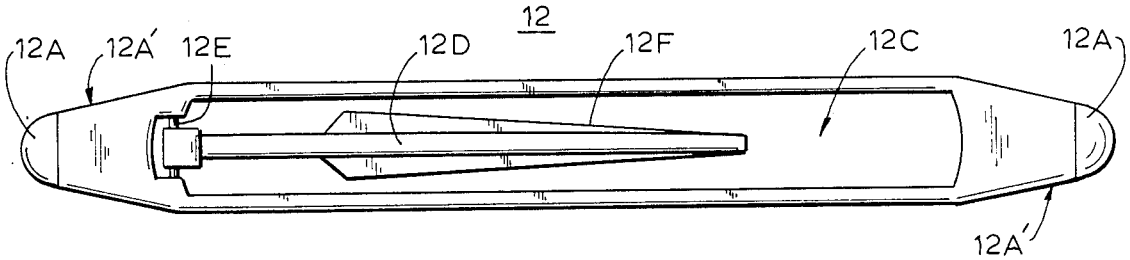
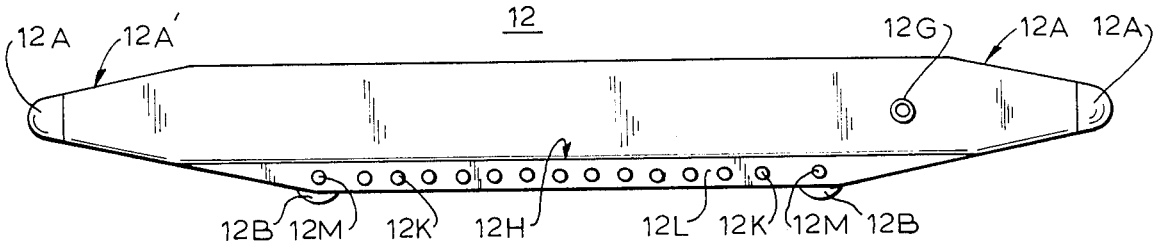
FIG. 4
FIG. 5
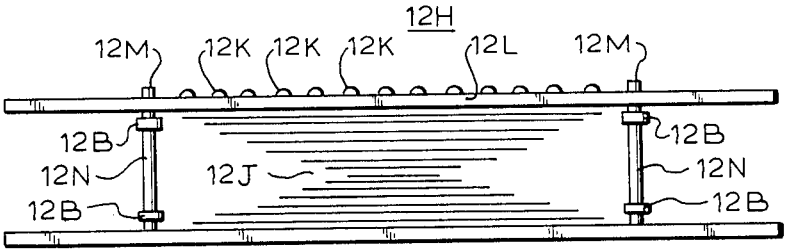
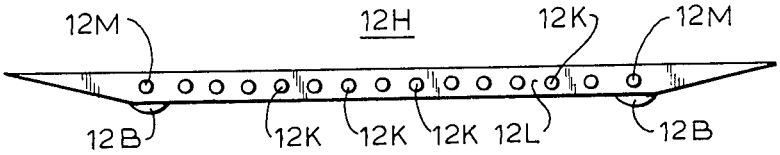
FIG. 6

SHUTTLE UNIT OF A LOOM

BACKGROUND OF THE INVENTION

The present invention relates to a shuttle unit for looms.

Known looms employ a striking mechanism to propel the shuttle back and forth by a sharp impact from the striking mechanism. Due to the repeated and powerful striking of the shuttle, the mechanism suffers from several disadvantages. The metal parts are subjected to strong vibrations and stresses, and repeatedly require adjustments. They are deformed and often break down, thus requiring frequent replacement. The mechanism is also subject to numerous malfunctions, caused by insufficient striking force on the shuttle, contact of the shuttle with the warp thread and/or weakening of the picking stick which imparts incorrect motion to the shuttle. If the striking force is adjusted too high, the shuttle can rebound off the shuttle box and cause injuries to workers. Because of the complex motion of the shuttle and the method of propulsion, the mechanism emits a high volume of noise, causes severe vibrations, limits the width of the material that can be produced and the speed of the shuttle, and thus the productivity of the machine.

SUMMARY OF THE INVENTION

Accordingly, it is an object of the present invention to provide a shuttle unit which avoids the disadvantages of the prior art.

More particularly, it is an object of the present invention to provide such a shuttle unit which no longer uses a striking mechanism for its propulsion and thereby eliminates all the disadvantages connected with this mechanism.

In keeping with these objects and with others which will become apparent hereinafter, one feature of the present invention resides, briefly stated, in a shuttle unit which includes a shuttle and means for forming a reversible electromagnetic field acting upon the shuttle to reciprocate the latter. The forming means is formed as a linear motor.

The linear motor can have a stator formed as a rail along which the shuttle travels, and the rotor of the linear motor is the shuttle in the form of a substantially cylindrical streamlined shuttle mounted on a travelling armature, permitting an air space between the stator and the travelling armature. The field is reversed by contactless switches contained in the shuttle boxes at each end of the stator rail. The speed of the shuttle depends on the frequency of the supply current. This means that, contrary to the existing designs, the attainable speed of the shuttle does not limit the width of the material, which can be from four to eight meters, and if required, of unlimited width. Abrasion of the shuttle on its track may be reduced to a minimum by mounting the shuttle and the armature within an endless belt of polymer material which the belt travels along the stator rail like a tank tread.

The shuttle unit in accordance with the present invention can easily be installed on existing looms. Only a few insignificant changes in the construction of the loom need be made, and these alterations do not in any way interfere with other operations of the loom.

The novel features of the present invention are set forth in particular in the appended claims. The invention itself, however, will be best understood from the following description of preferred embodiments, which is accomplished by the following drawing.

BRIEF DESCRIPTION OF THE DRAWING

FIGS. 3 and 4 are views showing a shuttle of the inventive shuttle unit;

FIGS. 5 and 6 are views showing a rotor of a linear motor of the inventive shuttle units.

DESCRIPTION OF PREFERRED EMBODIMENTS

Figure 1:
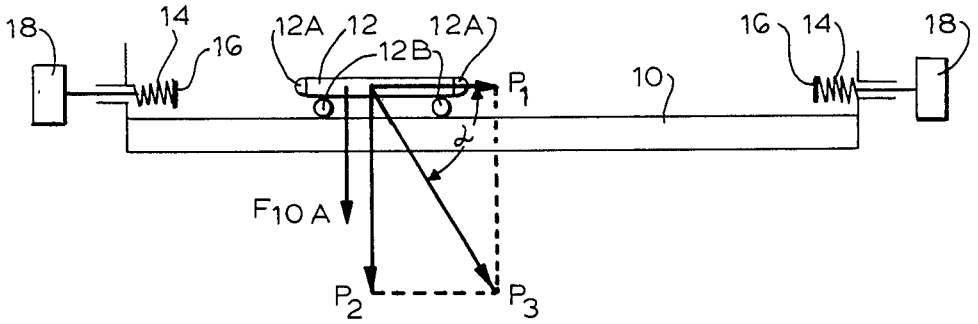
FIG. 1 is a schematic view showing a shuttle unit in accordance with one embodiment of the invention.
Figure 7:
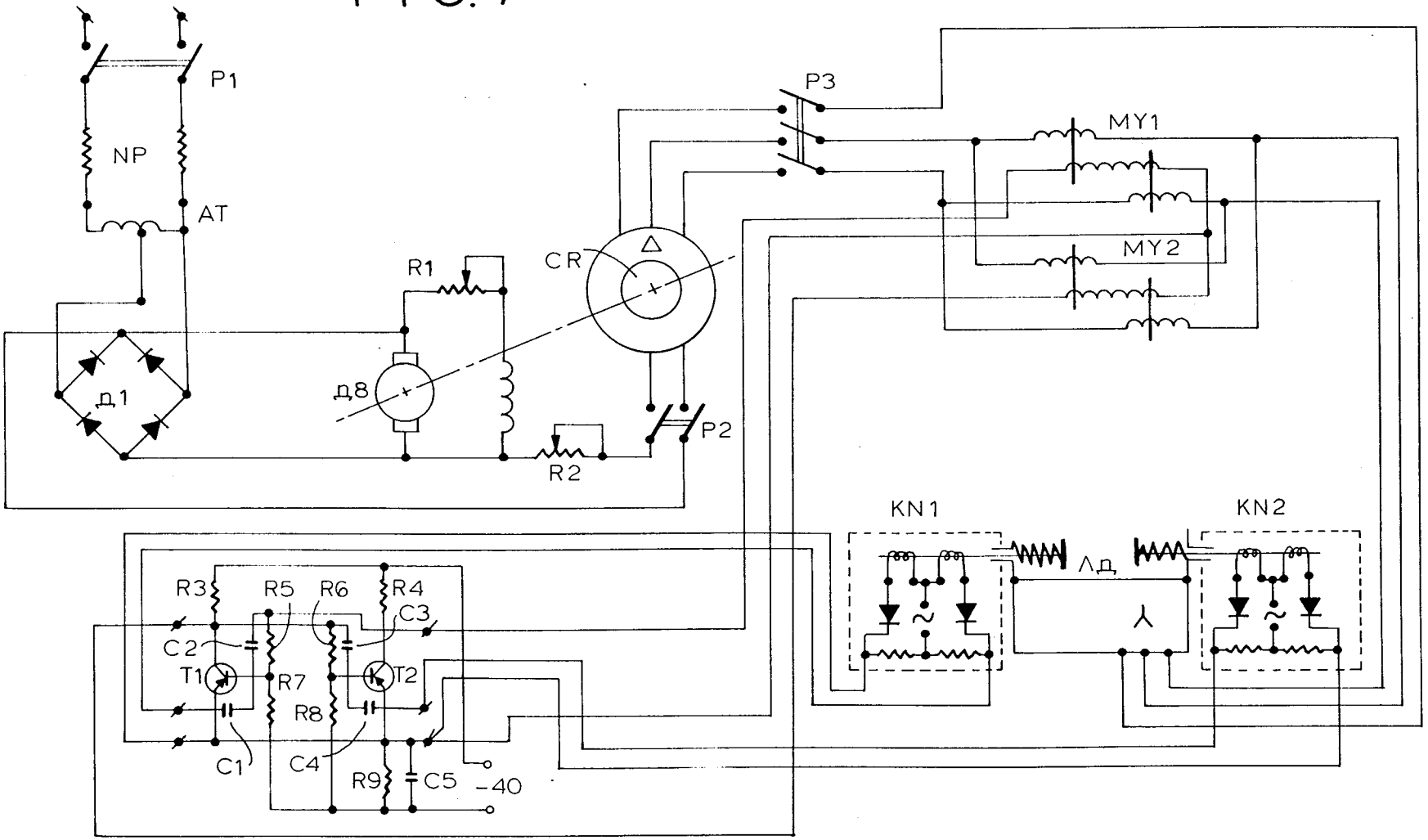
FIG. 7 is a view showing an electrical supply diagram for the linear motor.

A shuttle unit for a loom in accordance with the present invention includes a shuttle and means forming a reversible electromagnetic field for reciprocating the shuttle. The forming means is formed by a three-phase linear drive motor which can be of two types: with one stator and with two stators. The one-stator type is shown in FIG. 1. A stator 10 is composed of steel transformer plates bound together by two steel brackets and coated by a polymer layer with a thickness from 0.5 to 1.5 mm. The ends of the stator where the shuttle 12 imparts at the end of its travel across the shed are reinforced with plastic damping devices 14. A sensing rod 16 in each damping device 14 operates in conjunction with a contactless limit switch 18 when it meets the damping plate or tip 12A of the shuttle 12 as shown in FIG. 7.

In the shuttle 12 is placed a three-phase winding which determines the direction of the electromagnetic field. As the shuttle 12 operates one of the limit switches 18 the dynamic field reverses in the stator 10 and the shuttle 12 begins to move in the opposite direction. At the other end it contacts one of the damping devices 14, operates the limit switch 18 via the sensing rod 16 which reverses the field, and begins its motion back to the starting point. This back and forth motion of the shuttle 12 can thus be repeated indefinitely. In order to decrease the friction, the shuttle is supplied with wheels 12B. However, a great increase in pressure caused by the weight of the shuttle and downward force of the electromagnetic field can cause damage to the warp threads lying on the stator.

Figure 2:
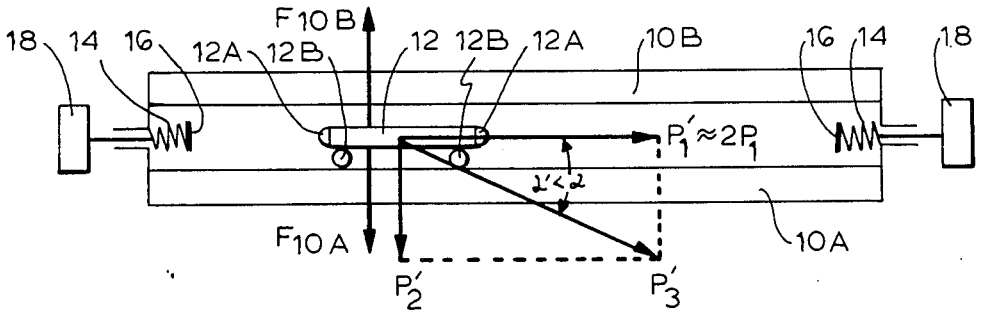
FIG. 2 is a schematic view showing a shuttle unit in accordance with another embodiment of the invention.

To avoid this, a two-stator design of the linear motor can be used as shown in FIG. 2. In this case the shuttle is affected by the following forces: the force F10B created by the dynamic electromagnetic field of an upper stator 10B, the force F10A created by the dynamic field of a lower stator 10A, and the weight P of the shuttle in accordance with the laws of physics. The first and second forces counteract each other in such a way that the net force P2' can equal the weight P of the shuttle. As can be seen from FIG. 2 the angle $\alpha'$ is much smaller than $\alpha$, that is the effectiveness of the linear motor has significant increase as shown by the vector diagrams and equations in FIGS. 1 and 2 the total sum of all the forces equal to $P_3'$ ($P_3$) and the resulting horizontal forces equal to $P_1'$ ($P_1$).

Thus, the new shuttle unit provides for a constantly accelerated motion, instead of constantly decelerated motion of the shuttle. With an optimal choice of the parameters, it will even be possible to eliminate the wheels from the shuttle. The upper stator of the linear motor must be detachable, in order to permit regular adjustments of the loom.

A power supply system for the shuttle unit in accordance with the present invention is shown in FIG. 7. The current is fed from a 220 volt a.c. supply through a switch P1 and fuse F to an autotransformer AT which is connected to two half-cycle semi-conductors in a rectifier bridge circuit D1 which supplies direct current to the motor M which drives a three phase alternator.

The use of the autotransformer permits regulation of the motor's cycle frequency through a wide range. In addition, the frequency of the motor M can be adjusted within a smaller range by the variable resistance R1,R2 included in the supply circuit. The frequency of the three-phase electric current from the alternator A can be adjusted within the range of 30 to 60 Hz., corresponding to a shuttle velocity of 3 to 6 meter per second, for both the one-stator and two-stator design. Of course, this adjustment can also be within wider limits.

Included in the contactless reversing circuit of the linear motor are two magnetic amplifiers MA1, MA2 each with two working windings and one directing winding, which represents a large resistance to alternating current. During the operation of the linear motor LM one of the magnetic amplifiers MA1,MA2 is turned on and the other is turned off during each half-cycle of the motor LM, thus providing contacless switching of the two-phases and reversal of the linear motor LM.

The design utilizes a trigger with power triodes T1,T2. As well-known, a trigger has two fixed positions. One of the triodes T1,T2 is permanently on, supplying current to the directing winding of the magnetic amplifier. Depending on which limit switch 18 is operated by the shuttle, one or the other arm of the trigger and its corresponding direction winding is activated.

The travelling armatures and shuttle assembly is best illustrated with reference to FIGS. 3–6. The shuttle 12 is shown as a generally cylindrical body having conical or tapered end portions 12A' at the outermost points of which are mounted the damping plates or tips 12A previously described with reference to FIGS. 1 and 2.

A spindle and spool cavity 12C is provided within the body of the shuttle 12 in which a spindle 12D is pivotally mounted on a cross-pin 12E. The spindle is provided with a suitable mounting spring 12F for receiving a spool or bobbin of thread in any suitable manner known in the art, which thread (not shown) exits the shuttle 12 through a thread guide or orifice 12G in the wall of the shuttle 12 adjacent to the right hand end of the cavity 12C as shown in FIGS. 3 and 4.

The shuttle 12 is mounted and carried on the upper surface of an armature 12H which is composed of a laminated core 12J of elongated ferromagnetic slats held together by transverse rods or pins 12K between a pair of parallel exterior side rails 12L. Across each end of the side rail 12L are mounted rollers or wheels 12B spaced apart on bearing pins 12M by collar means 12N.

In operation, when three phase current is applied to the stator 10 of the linear motor LM, the travelling field therein is in a first direction causing the armature 12H and the shuttle 12 to travel along the stator 10 into engagement with the damper plate 16 of one of the limit switches 18. The latter causes the magnetic amplifiers MA1, MA2 to be switched via the trigger triodes T1,T2 to reverse direction of travel of the field in the stator 10 and effect a reverse direction of travel of the shuttle 12 and its armature 12H, thereby carrying the shuttle back and forth across the shed of the loom with which it is associated.

Since the shuttle reversal is accomplished magnetically, the impact of the shuttle tips 12A on the damping plates 14 of the damped sensing rods 16 is the primary noise generation associated with this invention. It has been found that the large reductions in noise levels, on the order of 90% can be achieved in the loom with the shuttle unit of the present invention.

The lack of impact or hammer type drives for the shuttle requires less loom operating energy, on the order of 40% less. Elimination of vibrations in the loom and its environment, reduction in structural requirement is a result of reduced vibration with attendant savings in cost, weight and size of loom equipment and the mounting for same. The shuttle operates in a more controllable, satisfactory and safe mode. Furthermore, existing loom equipment can be readily adapted to the present invention while new equipment embodying the present invention will be of lesser initial cost. Last but not least, since shuttle speed and width of shed are selectively variable over a wide range, loom production increases on the order of 50% or more will be possible.

The invention is not limited to the details shown since various modifications and structural changes are possible without departing in any way from the spirit of the present invention.

What is desired to be protected by Letters Patent is set forth in particular in the appended claims.

We claim:

1. A shuttle unit of a loom, comprising a shuttle;

means forming a reversible electromagnetic field acting upon said shuttle so as to reciprocate said shuttle, said means including a reversible linear motor with an elongated stator having two ends and on which said shuttle moves, and a power supply for said reversible linear motor; and switching means for reversing said electromagnetic field, including a switch arranged on each end of said elongated stator, each of said switches including a winding connected therewith, and a sensing rod which is displaceable within said winding under the action of said shuttle so as to produce a magnetic field which actuates the position of the switch so as to reverse the electromagnetic field of said linear motor.

2. A shuttle unit as defined in claim 1, wherein said shuttle is provided with wheels permitting reciprocation of said shuttle.

3. A shuttle as defined in claim 1; and further comprising a damping device arranged on each end of said elongated stator, each of said damping devices including a damping plate against which said shuttle directly strikes and which is connected with said sensing rod.

4. A shuttle unit as defined in claim 1, wherein said reversible linear motor includes two such stators, said shuttle being reciprocable under the action of force created by said two stators and between said two stators.

5. A shuttle unit as defined in claim 1, and further comprising; and means for adjusting a frequency of power supply of said power supply source.

6. A shuttle unit as defined in claim 5, wherein said power supply source includes an autotransformer for adjusting the frequency in a relatively wide range and a variable resistance for adjusting the frequency in a smaller range.

7. A shuttle unit as defined in claim 1, wherein said stator is composed of steel transformer plates bound together by two steel brackets and coated by a polymer layer.

8. A shuttle unit as defined in claim 1 wherein said shuttle has a body, a spindle pivotally mounted on said body, a spring for receiving a bobbin with a thread exiting said body.

9. A shuttle unit as defined in claim 8 wherein said shuttle includes a travelling armature, said armature including a laminated core of elongated ferromagnetic slats, transverse rods holding together said slats, and a pair of parallel exterior side rails.

* * * * *

UNITED STATES PATENT AND TRADEMARK OFFICE

CERTIFICATE OF CORRECTION

PATENT NO. : 4,624,287

DATED : November 25, 1986

INVENTOR(S) : Isaak Kakitelashvili et al.

It is certified that error appears in the above-identified patent and that said Letters Patent is hereby corrected as shown below:

On the title page the inventor's name should read

--Isaak Kakitelashvili and

Shalva Kakitelashvili --.

Signed and Sealed this

Seventeenth Day of March, 1987

*Attest:*

DONALD J. QUIGG

*Attesting Officer*

*Commissioner of Patents and Trademarks*